United States Patent [19]

Gonner et al.

[11] Patent Number: 4,977,940

[45] Date of Patent: Dec. 18, 1990

[54] DEVICE FOR STRAIGHTENING BOARDS

[75] Inventors: Sigmar Gonner; Heinz-Hubert Braun, both of Oberkirch, Fed. Rep. of Germany

[73] Assignee: Gebruder Linck Maschinenfabrik "Gatterlinck" GmbH & Co. KG, Oberkirch, Fed. Rep. of Germany

[21] Appl. No.: 377,834

[22] PCT Filed: Jan. 5, 1988

[86] PCT No.: PCT/EP88/00005

§ 371 Date: Jun. 19, 1989

§ 102(e) Date: Jun. 19, 1989

[87] PCT Pub. No.: WO88/05371

PCT Pub. Date: Jul. 28, 1988

[30] Foreign Application Priority Data

Jan. 16, 1987 [DE] Fed. Rep. of Germany ..... 3701127

[51] Int. Cl.[5] ..... B25H 1/00

[52] U.S. Cl. ..... 144/255; 72/65; 72/107; 72/173; 144/2 R; 144/362; 100/176; 156/209

[58] Field of Search ..... 144/2 R, 255, 332, 362; 100/155 R, 160, 176; 72/65, 107, 173; 156/209, 220

[56] References Cited

U.S. PATENT DOCUMENTS

| | | | |
|---|---|---|---|
| 1,772,139 | 8/1930 | Hessenbruch | 72/65 |
| 2,574,248 | 11/1951 | Crowson | 72/107 |
| 2,973,793 | 3/1961 | Irvine | 144/332 |
| 3,722,562 | 3/1973 | Stegmuller | 144/332 |
| 4,139,467 | 2/1979 | Etzolo | 144/332 |

FOREIGN PATENT DOCUMENTS

| | | |
|---|---|---|
| 88336 | 9/1983 | European Pat. Off. . |
| 4296115 | 5/1969 | Fed. Rep. of Germany . |

*Primary Examiner*—W. Donald Bray

*Attorney, Agent, or Firm*—Burns, Doane, Swecker & Mathis

[57] ABSTRACT

Boards that have been separated by a chipless cutting method using an inclined blade, are twisted and, in most instances, this twist has to be corrected before boards that have been produced in this manner can be used. An apparatus in which a plurality of pairs of rollers are arranged in tandem withing a main frame is used to do this. Each pair of rollers can be pivotted about the longitudinal axis of the main frame relative to the proceding pair. This forms a board guide channel that extends in the longitudinal direction of the main frame and which is twisted approximately about the longitudinal axis of the main frame. The boards that are to be straightened pass through the board guide channel and are permanently deformed, which compensates for the twist that originally existed in the board.

16 Claims, 5 Drawing Sheets

DEVICE FOR STRAIGHTENING BOARDS

BACKGROUND AND OBJECTS OF THE INVENTION

The present invention relates to an apparatus for straightening boards and the like by means of rollers arranged within a main frame, between which the boards are guided.

In a known bend-straightening apparatus (DE-PS 32 07 548) boards and, in particular, boards that have been separated from the sides of a side-dressed log by chipless cutting, and similar flat wood products, which have a curve about a transverse axis, are straightened out between rollers.

In many instances, however, boards and the like, particularly those that have been produced by chipless cutting methods, have a twist in addition to the curvature discussed above, which is to say that they turn or twist about their longitudinal axis. In many applications, this deformation precludes any subsequent, automated processing. This twist grows greater, the more the separator blade is inclined to the longitudinal axis of the log.

It is the task of the present invention to create an apparatus for straightening boards and the like, which makes it possible to remove the above-discussed twist from the boards permanently, in one process that is as simple as possible.

SUMMARY OF THE INVENTION

According to the present invention, this task has been solved in that a board guide channel that extends in the longitudinal direction of the apparatus, and which is twisted approximately about the longitudinal axis of the apparatus, is formed in that a plurality of pairs of rollers are arranged in tandem, these being pivotted in each instance about the longitudinal axis of the frame, relative to the preceding pair of rollers.

Immediately after they have been produced, the boards pass through the board guide channel that is so formed and which has a twist that is opposite to the twist in the boards. This means that as the boards pass through the apparatus they are subjected to a continuous twisting that is opposite to the direction of the twist already in them. Thus, the boards are straightened so that ultimately they are permanently flat.

Since the boards can pass through the board guide channel at a relatively high speed, this matches the operating speeds achieved in the chipless separation of the boards, which can also be very high. The apparatus according to the present invention can be incorporated after the apparatus used for the chipless separation of the boards, either immediately or with a bend-straightening apparatus interposed between them.

Another embodiment that lies within the context of the present invention foresees that two conveyor belts extend from one pair of inlet rollers to a pair of outlet rollers that are offset relative to the first pair; that the two opposing sides of the conveyor belts, which are also twisted, form a board guide channel betwen themselves; and at least one of the conveyor belts is driven. The boards are guided totally and continuously by the conveyor belts.

A development of the concept of the present invention foresees that the pairs of rollers can be pivotted so that a greater twist can be imparted to the board guide channel, so as to adapt it to operating requirements.

Most expediently, the lower roller of each pair of rollers, or the rollers that guide the lower conveyor belt, can be swung or folded down, so that fragments of wood, which can fall, for example, in the event of an imperfect log, can be removed easily from the apparatus.

The concept of the present invention foresees that the two rollers that make up each pair of rollers can be adjusted relative to each other so as to permit them to be adapted to boards of various thicknesses.

THE DRAWINGS

The invention is described in greater detail below, on the basis of embodiments shown in the drawings appended hereto. These drawings show the following:

FIG. 1: A simplified representation of an apparatus to straighten boards, this being in side view and in partial longitudinal cross-section;

FIG. 2: A cross-section on the line II—II in FIG. 1;

FIG. 3: A view as in FIG. 2, with the lower roller swung down;

FIG. 4: A simplified plan view of the apparatus as in FIGS. 1 to 3;

FIG. 5: A modified embodiment of the invention, in a view corresponding to FIG. 1; FIG. 6: A cross-section on the line VI—VI in FIG. 5;

FIG. 7: A view as in FIG. 6, with the lower roller swung down;

FIG. 8: A further embodiment of an apparatus according to the present invention, this being in side view and in partial cross-section;

FIG. 9: A view in the direction indicated by the arrow IX in FIG. 8;

FIG. 10: A cross-section on the line X—X in FIG. 8.

DETAILED DESCRIPTION OF A PREFERRED EMBODIMENT OF THE INVENTION

Figure 1:
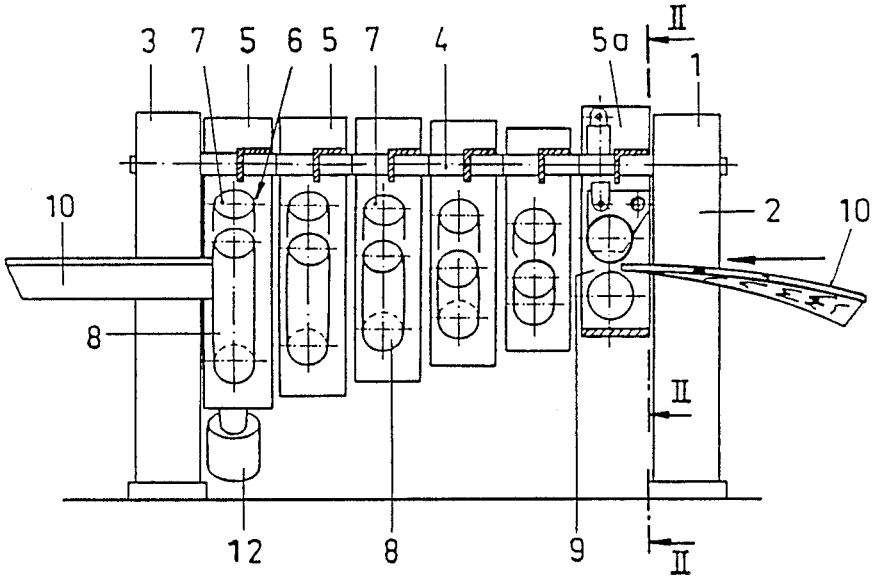

The apparatus that is shown in FIGS. 1 to 4 has a main frame 1 that consists essentially of two arch-like stands 2 and 3 at the inlet and outlets ends, respectively, of the apparatus The inlet and outlet ends are spaced apart in a longitudinal direction. A shaft 4 connects the two stands 2 and 3 and extends in the longitudinal direction.

The shaft 4 forms a pivotting axis for a plurality of roller frames 5 that are arranged in tandem; each of these has a pair 6 of rollers that comprise an upper roller 7, and a lower roller 8 that is arranged parallel to and at a distance from this.

Figure 2:
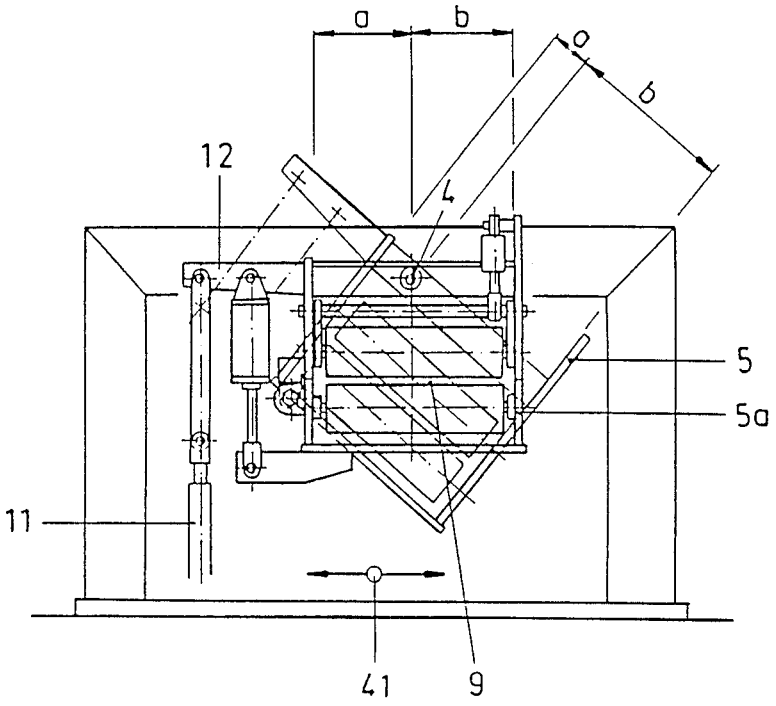

In FIG. 2, the roller 5*a* that is arranged at the entrance to the main frame is indicated by normal lines. In FIG. 2, the roller frame 5 that is arranged at the exit is indicated by thin lines. It can be seen that the roller frame 5 is pivotted about the shaft 4 relative to the roller frame 5*a*. That is, those frames are pivotally offset relative to each other. It can also be seen that the pivotting axis 4 runs through the mid-point of the first roller frame 5*a*, i.e., the dimensions a and b that are indicated in the drawing are equal. In roller frame 5, the pivotting axis 4 has been shifted off centre, which is to say that the dimension a is considerably smaller than the dimension b. In a similar manner, all the roller frames 5 have been pivotted or tilted about the longitudinal axis of the frame, relative to the previous roller frame, by a specific angular amount. This forms a board guide channel 9 (FIG. 2) between the rollers 7 and 8, said channel extending in the longitudinal direction of the frame and being twisted along its whole length. The boards 10, which in their starting state also incorporate a twist that is the opposite of the twist in the guide channel and which are to be straightened (FIG. 10), pass through this board guide channel 9. Having passed through the board guide channel 9 the boards 10 emerge straightened, as is shown in FIG. 1. The angle of twist of the board guide channel is so selected by the pivotting of the roller frames 5 that it causes a permanent deformation in each of the boards 10 that are to be processed, this new twist compensating for the original twist in the boards 10.

In order to permit matching to the various deformations in the boards, each of the roller frames 5 is connected to a pivot drive 11 that can be formed, for example, by a hydraulic cylinder that acts on a side arm 12 of the roller frame 5.

At least one roller 8 in the exit side roller frame 5 is fitted with a roller-drive system 12 that serves to move the board 10 to the exit of the apparatus.

Figure 3:
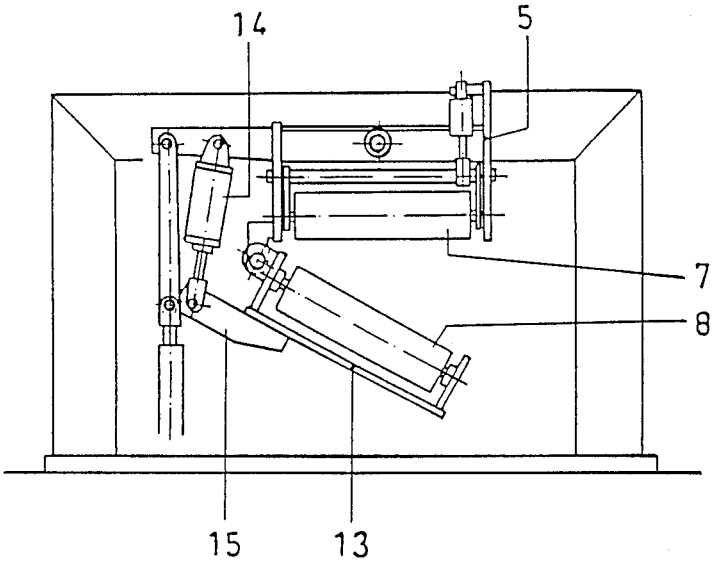

In order to make it possible to open the board guide channel 9, the under part 13 of each roller frame 5 or 5*a*, respectively, can be swung down, as is shown in FIG. 3. To this end, a hydraulic cylinder 15, which forms a folding drive system, acts on an arm 15 of the frame element 13. Fragments of wood or pieces of the boards that have collected or become jammed in the board guide channel 9 can thus be removed very simply by swinging the rollers 8 down, whereupon these fragments either fall out themselves, or can be easily removed.

Figure 4:
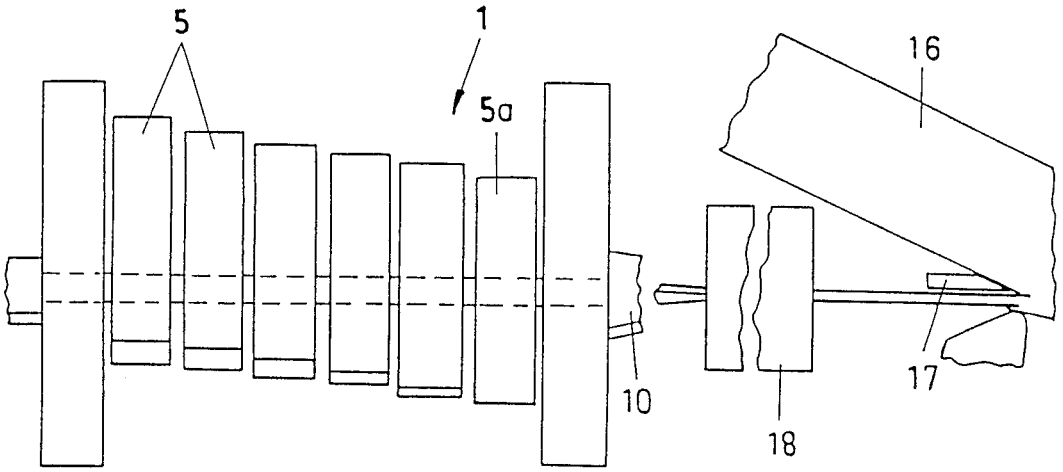

FIG. 4 is a plan view that shows the lateral offset of the roller frames 5 that follow each other. In addition, FIG. 4 also shows that, in the most important application of the apparatus according to the present invention, the boards 10 that are to be straightened are separated from a log 16, which has been side dressed by chipless cutting. After passing through a bend-straightening apparatus 18 that removes any curvature from the boards 10, and which is only shown schematically in FIG. 4, the boards 10 pass directly into the apparatus that takes the twist out of the boards. The size and direction of this twist depends essentially on the inclined position of the blades 17.

Figure 5:
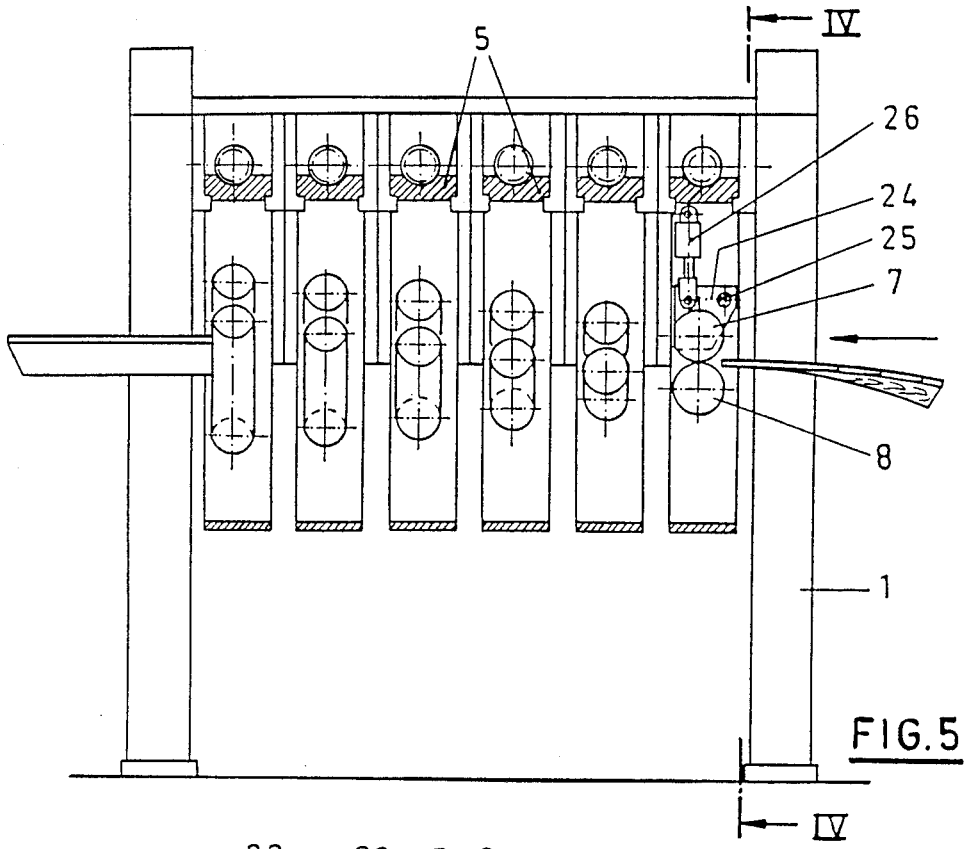
Figure 6:
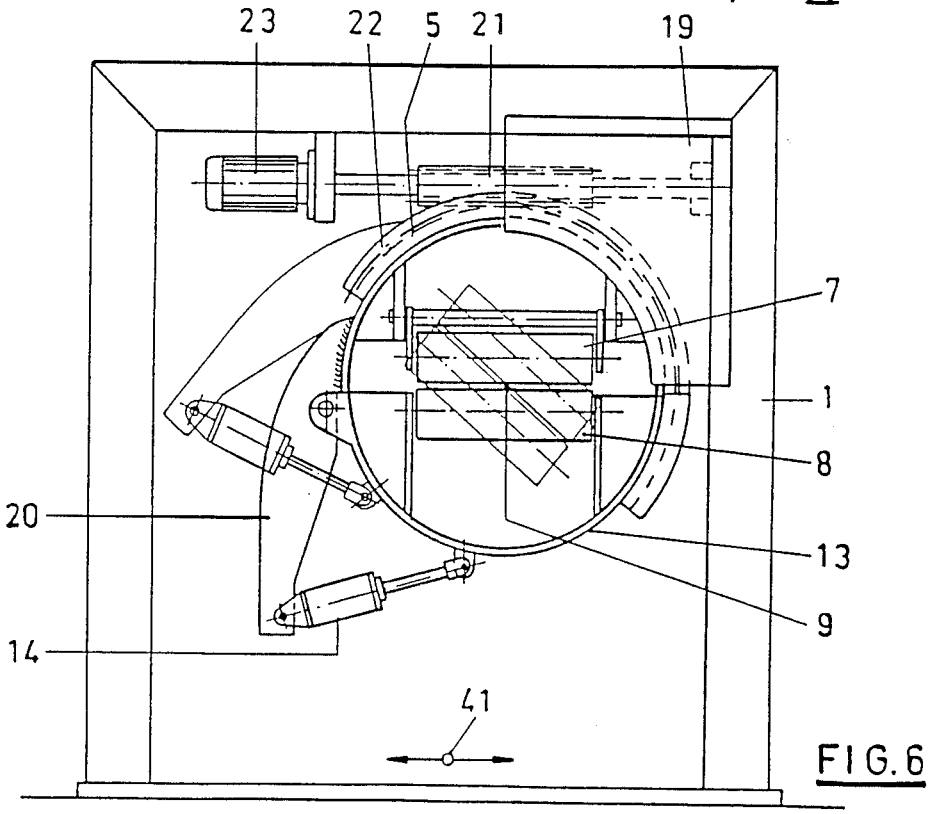
Figure 7:
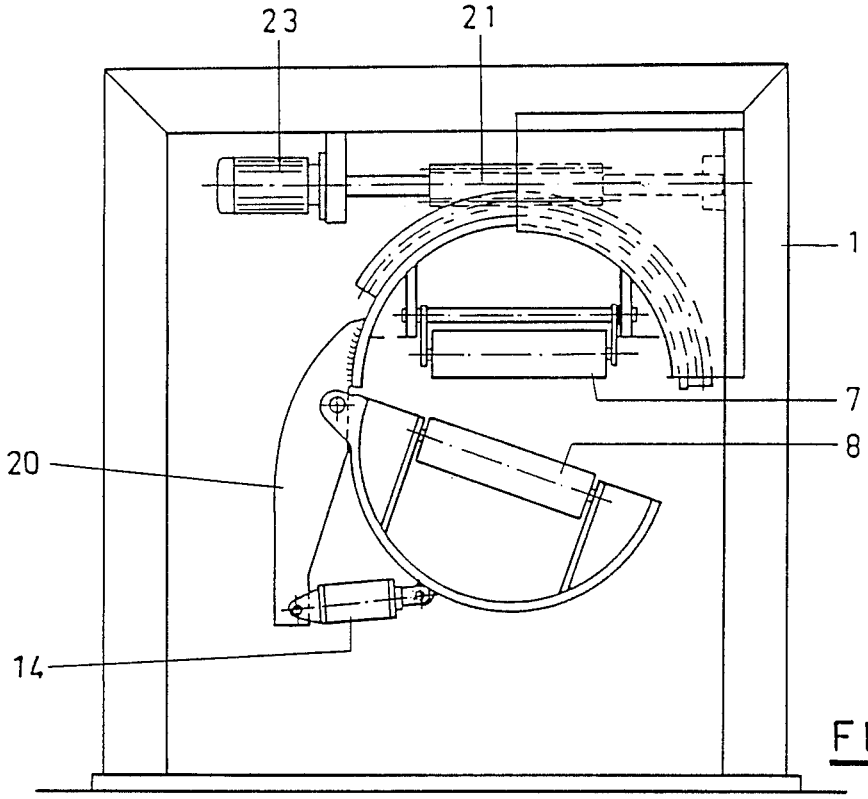

Essentially, the modified embodiment that is shown in FIG. 5 to 7 differs from the embodiment described above, which is shown in FIGS. 1 to 4, only in that the individual roller frames 5, which are arranged in tandem, can be pivotted about a longitudinal axis of the frame that coincides approximately with the board guide channel 9. Here, each of the roller frames 5 forms a ring in which the rollers 7, 8 are supported. These ring-like roller frames 5 are each guided on a circular path within a guide in a guide element 19, the longitudinal axis of the frame being located at the mid-point of this circular path.

Here, too, the roller frame 5 is so designed as to swing down. A hydraulic cylinder 14 that is attached to an arm 20 that is connected to the roller frame 5 acts on the lower element 13 of the frame, in which the roller 8 is supported.

In the embodiment shown in FIGS. 5 to 7 there is a worm drive 21 that acts as the pivot drive; this drives a worm-drive segment 22 on the ring-shaped roller frame 5 by means of a positioning motor 23.

In order to provide for adjustment to accommodate different board thicknesses, in the embodiment shown in FIGS. 1 to 7 it is foreseen that in each roller frame 5 or 5*a*, respectively, the upper roller 7 can be adjusted relative to the lower roller 8. To this end, the upper roller 7 can be pivotted about a pivotting axis 25 on a side arm 24. The pivotting adjustment is effected by means of a hydraulic cylinder 26.

Figure 8:
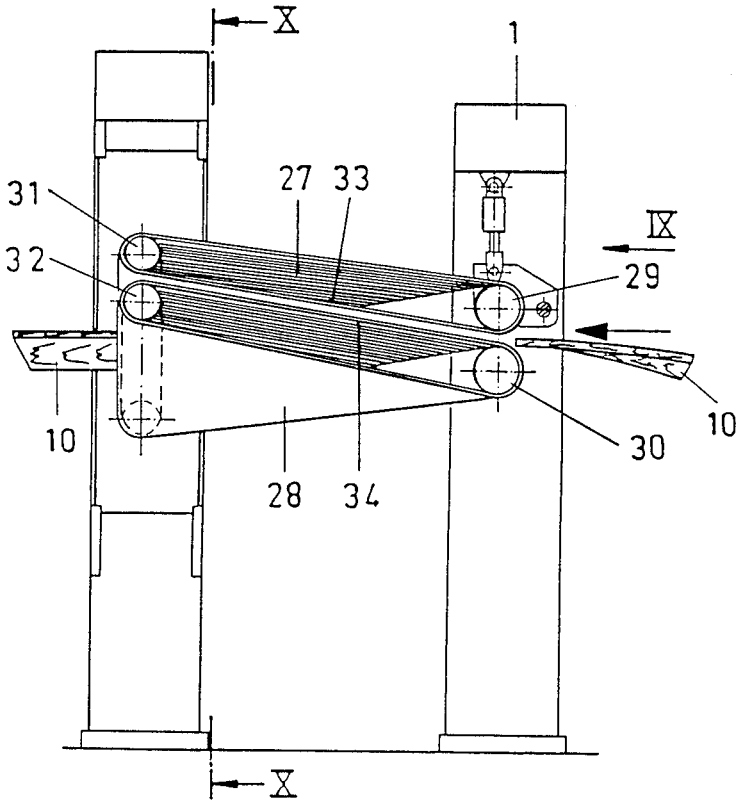
Figure 9:
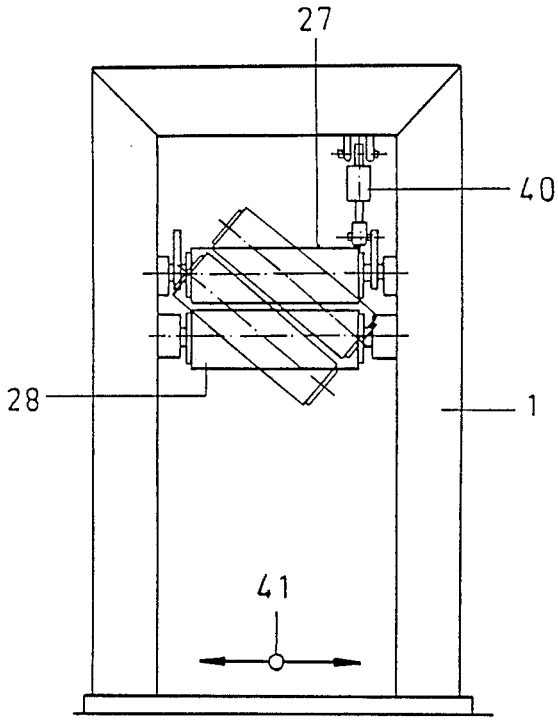
Figure 10:
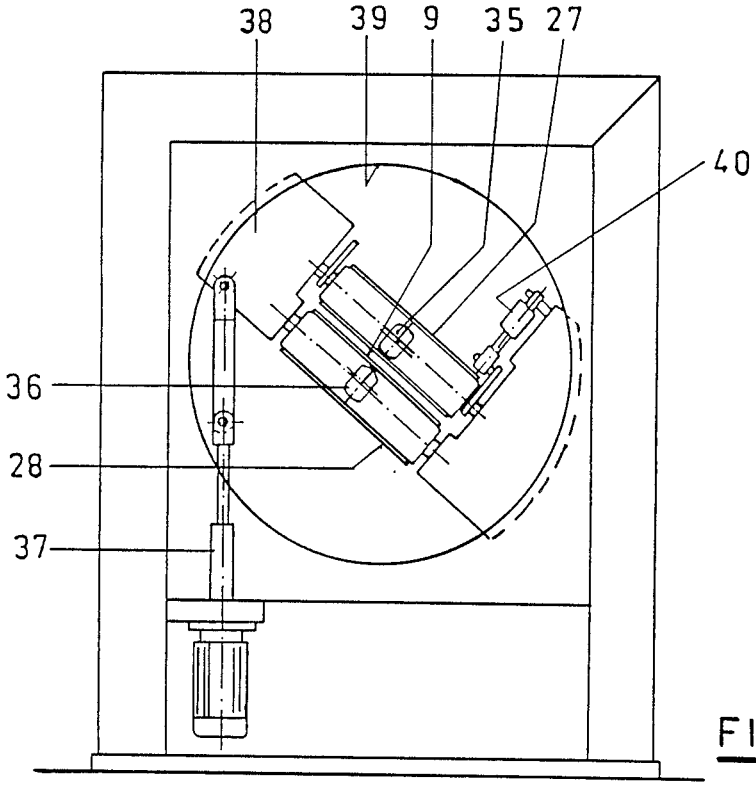

FIGS. 8 to 10 show a further embodiment of the apparatus. Two conveyor belts 27 and 28 extend from a pair of input rollers 29, 30 to a pair of output rollers 31, 32 that are offset relative to the input rollers. Thus, the two conveyor belts 27, 28 are twisted as viewed in their longitudinal direction; between themselves, they form the board guide channel 9, which is also twisted in the same way; the board 10 that is to be straightened passes through this board guide channel. The offset conveyor belts 27, 28 can be rubber belts that have a fabric insert, or they can be metal-link belts or chain belts.

In order to prevent the board 10 that is passing through the board guide channel from forcing the belt runs 33 and 34, which face each other, apart in the centre area of the conveyor belts 27, 28, crowned supporting rollers 35, 36 can be arranged, preferably in the centre area of the conveyor belts 27, 28, on the rear side of both sides 33, 34 (FIG. 10). At least one of the two conveyor belts 27, 28 is driven, in order that the boards 10 that pass through are moved completely out of the apparatus.

FIG. 10 shows that the pair of rollers 31, 32 on the output side can be pivotted relative to the pair of rollers 29, 30 on the input side, in order to change the angle of twist of the board guide channel 9 that is formed, so that it is in keeping with the specific operating conditions. This is done with a pivot drive 37 that moves a roller frame, which is in this instance made up of two parts, on a circular path formed by a circular section 39.

There is an adjuster system 40 on the two pairs of rollers 29, 30, or 31, 32, respectively, in this embodiment, too; this permits adjustment of the upper roller 29 or 31, respectively, relative to the lower roller 20 or 32, respectively, so as to accommodate the various board thicknesses that are encountered, as has been described heretofore.

In the embodiment shown in FIGS. 8 to 10, it can be arranged that the rollers 30, 32 that support the lower conveyor belt 28 can be swung downwards in order to open the board guide channel 9 if fragments of wood that have fallen into it have to be removed.

It is common to all the embodiments shown that provision can be made for lateral adjustment of the whole main frame 1, as is indicated by the arrows 41 in FIGS. 2, 6 and 9.

In the embodiment shown in FIGS. 1 to 7, the pairs of rollers 7, 8 that are arranged in tandem can be so set that the board guide channel 9 is curved. In this way it is possible to straighten the board 10 in its longitudinal direction; this makes it possible to dispense with a separate straightening apparatus 18.

We claim:

1. Apparatus for straightening twisted boards, comprising:

a main frame having a board inlet end and a board outlet end spaced from said board inlet end, in a longitudinal direction, a plurality of frames mounted in said main frame for pivotal movement relative to said main frame and relative to one another about a pivot axis extending substantially in said longitudinal direction; and a pair of rollers mounted in each of said frames for rotation about axes extending transversely relative to said longitudinal direction, said roller pairs defining a channel for conducting boards from said inlet end to said outlet end;

said frames being pivotally offset relative to one another whereby said channel defined by said roller pairs is twisted about said longitudinal direction.

2. Apparatus according to claim 1, wherein said pivot axis lies outside of said channel defined by said roller pairs.

3. Apparatus according to claim 2, wherein successive ones of said frames are relatively offset in a direction transversely of said axis, such offset relationship progressing gradually from said inlet end to said outlet end.

4. Apparatus according to claim 1, wherein said pivot axis lies within said channel defined by said roller pairs.

5. Apparatus according to claim 4, wherein said main frame has a plurality of guides shaped as arcs, said pivot axis defining a common central axis of said arcs, said frames being slidably mounted in respective ones of said guides.

6. Apparatus according to claim 1, wherein one roller of each of said roller pairs is movable toward and away from the other roller.

7. Apparatus according to claim 1 including separate drive means for pivoting each of said frames.

8. Apparatus according to claim 1, wherein a roller of each roller pair is adjustable to vary a spacing therebetween.

9. Apparatus according to claim 1, wherein said main frame is adjustably movable in a direction transversely of said longitudinal direction.

10. Apparatus according to claim 1, wherein said roller pairs are arranged such that said channel defined thereby is curved in a direction transversely of said longitudinal direction.

11. Apparatus for straightening boards, comprising:

a main frame having a board inlet end and a board outlet end spaced from said board inlet end in a longitudinal direction, a pair of first rollers disposed adjacent said inlet end and arranged to conduct boards therebetween, a pair of second rollers disposed adjacent said outlet end and arranged to conduct boards therebetween, a first conveyor belt extending between one of said first rollers and one of said second rollers, and a second conveyor belt extending between the other of said first rollers and the other of said second rollers and situated opposite said first conveyor belt such that said conveyor belts form a board-guiding channel therebetween, at least one of said conveyor belts being driven to feed boards, said conveyor belts being twisted about an axis extending substantially in said longitudinal direction whereby said channel is twisted about said axis.

12. Apparatus according to claim 11, wherein said conveyor belts include opposing runs for conducting the boards, each of said runs having a board-contacting front side and an opposing back side, a plurality of support rollers arranged to contact said back sides of said runs.

13. Apparatus according to claim 11, wherein one of said first rollers and one of said second rollers is movable toward and away from said other first roller and said other second roller, respectively.

14. Apparatus according to claim 11 including a frame in which one of said pairs of rollers is mounted, said frame being rotatable about an axis extending substantially in said longitudinal direction to adjust the amount of twist of said conveyor belts.

15. Apparatus according to claim 11, wherein one of said first rollers is adjustable to vary a spacing between said first rollers, and one of said second rollers is adjustable to vary a spacing between said second rollers.

16. Apparatus according to claim 11, wherein said main frame is adjustably movable in a direction transversely of said longitudinal direction.

* * * * *